United States Patent [19]

Villeval

[11] Patent Number: 4,463,802

[45] Date of Patent: Aug. 7, 1984

[54] WATER BOX AND EXPANSION CHAMBER DEVICE, E.G. FOR AN INTERNAL COMBUSTION ENGINE RADIATOR

[75] Inventor: Denis Villeval, Maurepas, France

[73] Assignee: Valeo, Paris, France

[21] Appl. No.: 404,854

[22] Filed: Aug. 3, 1982

[30] Foreign Application Priority Data

Aug. 12, 1981 [FR] France ..... 81 15627

[51] Int. Cl.[3] ..... F28D 13/00

[52] U.S. Cl. ..... 165/104.32; 123/41.54

[58] Field of Search ..... 165/104.32, 111; 123/41.44, 41.51, 41.54

[56] References Cited

U.S. PATENT DOCUMENTS

| | | | |
|---|---|---|---|
| 3,455,377 | 7/1969 | Hayes | 165/104.32 X |
| 4,116,268 | 9/1978 | Kruger | 165/111 |
| 4,289,507 | 9/1981 | Cadars et al. | 165/104.32 X |
| 4,366,858 | 1/1983 | Moranne | 123/41.54 X |

FOREIGN PATENT DOCUMENTS 2465987 3/1981 France .

*Primary Examiner*—Albert W. Davis, Jr.

*Attorney, Agent, or Firm*—Dennison, Meserole, Pollack & Scheiner

[57] ABSTRACT

The water box and expansion chamber for the radiator of an internal combustion engine radiator may be moulded as a single piece. The water box (12) and the expansion chamber (11) are connected in the usual way near the top by a degassing duct. Near the bottom it is important to provide suction in the expansion chamber to ensure effective degassing. Suction may either be provided by a channel (21) enabling the main outlet flow of fluid from the radiator to entrain fluid from the expansion chamber, or it may be provided by a separate suction outlet (30) for connection to a pump. Different kinds of engine use different suction systems. The present invention allows both systems to be catered for by a single type of device in which the unwanted suction path is readily closed off, either during the original moulding operation (e.g. wall 31) or by means of a stopper (20) that provides a path when inserted in out orientation, but which closes a path when turned to another orientation.

9 Claims, 6 Drawing Figures

WATER BOX AND EXPANSION CHAMBER DEVICE, E.G. FOR AN INTERNAL COMBUSTION ENGINE RADIATOR

The present invention relates to a water box and expansion chamber device (eg. a single moulded part) for use in a heat exchanger such as the radiator of an internal combustion engine cooling system.

BACKGROUND OF THE INVENTION

In such a device, the expansion chamber and the water box are generally interconnected by an upper passage which constitutes a degassing duct, and by a lower passage which provides a suction orifice. The degassing duct serves to trap bubbles of air or gas in the water box and coming from the cooling liquid and to discharge them into the expansion chamber in order to avoid the risk of "hot spots" in the engine block.

To enable said degassing to operate, the expansion chamber is kept at a lower pressure than the water box by means of suction generated by the cooling liquid flowing out from the water box towards an outlet tube thereform and past the lower or suction orifice or passage.

However, in many practical cases, the outlet tube is sufficiently bulky to require some special orientation to be able to fit in the space available. This can lead to the flow of liquid to the outlet tube creating back pressure rather than suction in the vicinity of the lower or suction orifice or passage. This hinders putting the expansion chamber at reduced pressure and prevents proper degassing of the liquid circulating in the cooling circuit.

Preferred embodiments of the present invention provide a water box and expansion chamber device, preferably in the form of a single moulding, which avoids the above drawback, and in which degassing effectiveness is maintained regardless of the direction in which the outlet tube leaves the bottom of the water box.

SUMMARY OF THE INVENTION

The present invention provides a water box and expansion chamber device for a heat exchanger such as a radiator in the cooling circuit of an internal combustion engine, wherein the expansion chamber and the water box are connected by an upper degassing passage, wherein the bottom of the water box is provided with an outlet tube for fluid outlet from the heat exchanger, and wherein a communication channel connects the expansion chamber to said outlet tube, eg. substantially to the inlet thereof, while separating expansion chamber from the water box per se.

Thus the suction developed in the expansion chamber by the communication channel is independent of the conditions of liquid flow in the water box immediately upstream from the outlet tube, since the communication channel connects the expansion chamber directly to the outlet tube.

Preferably the communication channel points substantially parallel to the axis of the outlet tube where it opens out therein.

This maximises suction of the liquid in the expansion chamber by the communication channel.

The device may be used in two different applications that require differing modes of operation. Engine cooling circuits exist which are controlled by a thermostatically controlled valve which serves to short circuit the radiator while the temperature of the cooling liquid remains below a threshold value, for example in order to reduce the warming up period of the engine after a cold start. Putting the thermostatically controlled valve in the short circuit position generally means that the cooling is not degassed, since the degassing means are in the radiator which the valve is short circuiting.

However, in some cases, particularly when the engine is a Diesel engine, it is desirable for the cooling liquid to be degassed even when the radiator is being short circuited. To do this, a direct connection is provided from the bottom of the expansion chamber to the suction side of a pump for circulating liquid in the cooling circuit.

At the price of a very small and cheap modification during moulding or assembly (or both), the device in accordance with the present invention can be made for one or other type of expansion chamber suction.

BRIEF DESCRIPTION OF THE DRAWINGS

Embodiments of the invention are described by way of example with reference to the accompanying drawings, in which.

MORE DETAILED DESCRIPTION

Figure 1:
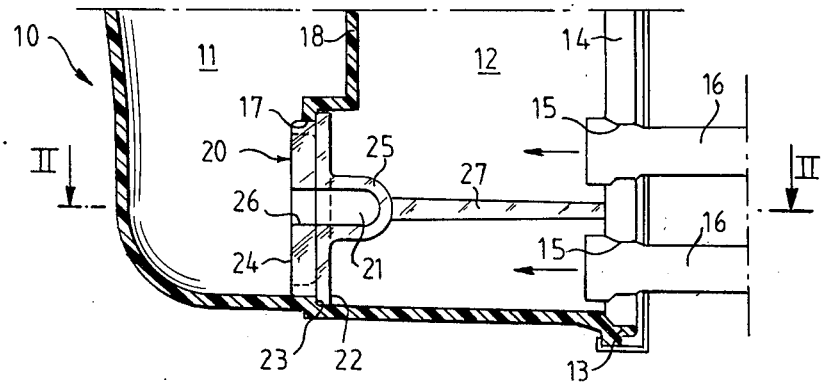
FIG. 1 is a diagrammatic partial section through the lower portion of a water box and expansion chamber device in accordance with the invention.
Figure 2:
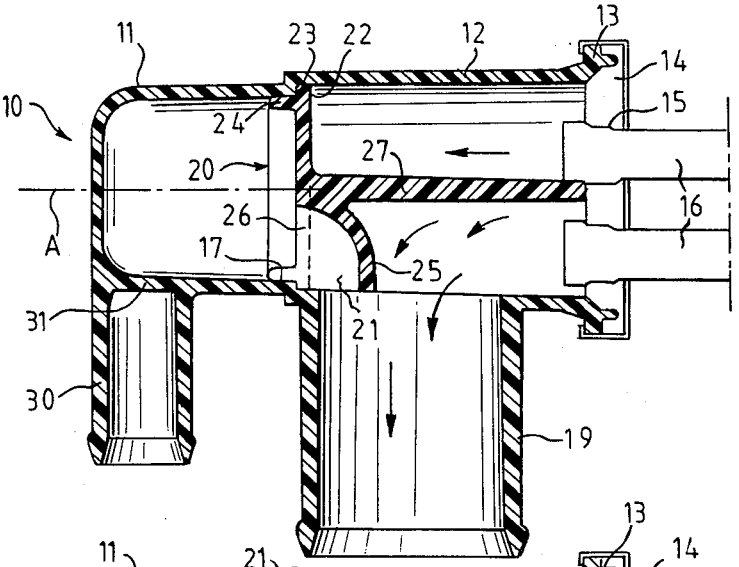
FIG. 2 is a section along a line II—II of FIG. 1 showing a first version of the device suitable for a first type of cooling circuit.

Reference is made initially to FIGS. 1 and 2 which show a first embodiment of the invention, suitable for use in the first type of cooling circuit mentioned above (in particular for a gasoline engine).

The device 10 in accordance with the invention comprises an expansion chamber 11 and a water box 12 which are made in a single piece, eg. by moulding. In the usual manner, the water box 12 has an open face delimited by a rim 13 for mounting on a tube plate 14 through which there pass the ends 15 of tubes 16 belonging to the core of a heat exchanger, eg. a radiator.

The water box 12 communicates with the expansion chamber 11 both via a degassing duct or passage (not shown) which connects the top of the water box 12 to a portion of the expansion chamber 11 which is preferably below the level of liquid contained therein, and via a bottom orifice or passage 17 through the wall 18 which separates the expansion chamber 11 from the water box 12.

The bottom portion of the water box 12 is formed with a heat exchanger outlet tube 19 which may be moulded in one piece with the wall of the water box. The outlet tube 19 is in the form of a cylindrical stub (FIG. 2) extending perpendicularly to the longitudinal mid plane A of the water box 12, ie. at right angles to the plane defined by the bundle of heat exchanger tubes, which is the same as being at right angles to the plane of FIG. 1.

A radiator incorporating a water box and expansion chamber device 10 in accordance with the invention is used with an engine. When the engine is running, the cooling liquid flows through the water boxes and along the tubes of the heat exchanger, finally leaving via the ends 15 of the bottom tubes 16 into the bottom of the water box 12 and hence into the outlet tube 19 from the heat exchanger, as indicated by arrows in FIGS. 1 and 2. Thus, until it is deflected through a right angle to pass through the outlet tube 19, the liquid leaving the ends 15 of the bottom tubes 16 flows substantially directly towards the the orifice 17 connecting the water box 12 to the expansion chamber 11. This liquid trajectory creates a local back pressure or pressure increase in the immediate surroundings of the orifice 17, and this excess pressure renders the degassing substantially ineffective, since degassing is only effective, as explained above, if the flow of liquid through the outlet tube 19 causes in expansion chamber 11 suction through the orifice 17.

To remove this local overpressure effect around the orifice 17, the invention provides to close the orifice by means of a member 20 which constitutes a stopper having a communication channel leading from the inside of the expansion chamber 11 to the outlet tube 19.

In the example shown in the drawing, the member 20 is in the shape of a circular disk whose periphery 22 is pressed from the water box side against a shoulder 23 around the rim of the orifice 17. A cylindrical skirt or flange 24 projects from the disk and is a tight fit in the orifice 17 through the wall 18.

The channel 21 is delimited by a portion 25 of the circular disk which plugs the orifice 17. Said portion 25 is curved through substantially one fourth of a circle and serves a shield or screen by deflecting the fluid flowing out from the ends 15 of the bottom tubes 16 of the heat exchanger core away from the orifice 17. Fluid communication is maintained via a radial slot 26 formed through the skirt 24 and the disk 20 inside the portion 25.

The opening of the channel 21 level with the inlet to the outlet tube 19 is now aligned with the direction of liquid flow therethrough.

The member 20 is held in place in the orifice 17 by thrust from the tube plate 14 of the radiator core. Said thrust is transmitted by a rod or strut 27 which projects perpendicularly from the disk for the required distance.

The member 20 is placed in the orifice 17 by insertion from the water box 12 before the water box 12 is itself assembled on the tube plate 14 of the radiator core.

The flow of liquid through the heat exchanger and into the outlet tube 19 therefrom, provides suction in the channel 21, thereby reducing the pressure in the bottom of the expansion chamber 11 and promoting degassing from the liquid, as explained above.

Figure 3:
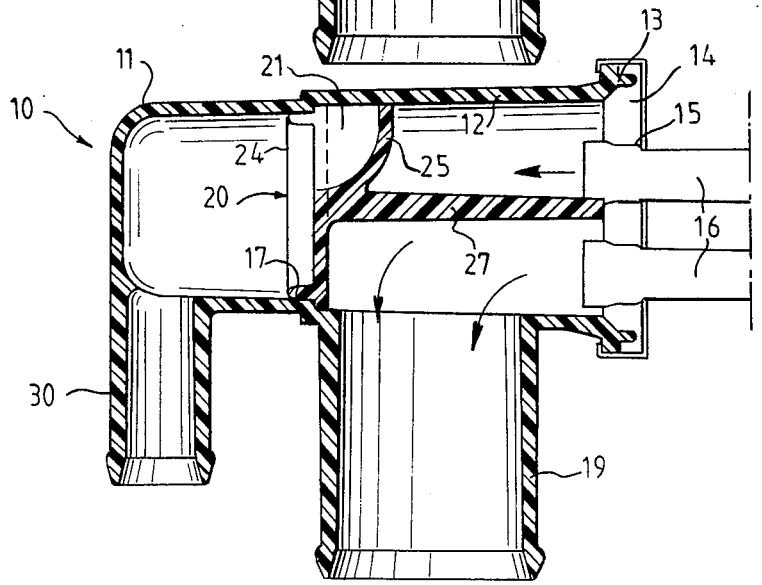
FIG. 3 is a similar view to FIG. 2, but showing a second version of the device for a second type of cooling circuit, and in particular for a diesel engine.

In FIG. 3, which shows a modified version of the device for use in a radiator in the second type of cooling circuit, in which degassing is possible when the thermostat valve is closed, the member 20 is turned through about 180° in the orifice 17 such that the outlet from the channel 21 points away from the outlet tube 19 and is thus closed by the wall of the water box 12. The liquid leaving the the ends 15 of the bottom tubes 16 in the heat exchanger core thus reach the outlet tube 19 by flowing in the direction indicated by the arrows in FIG. 3, and thus without creating suction in the expansion chamber 11. Indeed there is no communication between the expansion chamber 11 and the water box 12 via the orifice 17.

A cylindrical stub outlet tube 30 projects from the bottom of the expansion chamber 11, made in the same moulding operation as the rest of the expansion chamber 11. The outlet tube 30 is intended to communicate with the suction side of a pump for circulating the cooling liquid. It is suction produced by the pump that reduces the pressure inside the expansion chamber and ensures effective degassing of the liquid.

In the version shown in FIG. 2, the tube 30 is present but plugged by a wall 31 which forms part of the same moulding as the tube 30 and the expansion chamber 11.

Thus, to go from the first version to the second, two steps only are required: during moulding the plug wall portion 31 is omitted, and during assembly, the stopper member 20 is disposed in the orifice 17 through the wall 18 in such a manner that the communication channel 21 is plugged by the wall of the water box 12 opposite the outlet tube 19.

Figure 4:
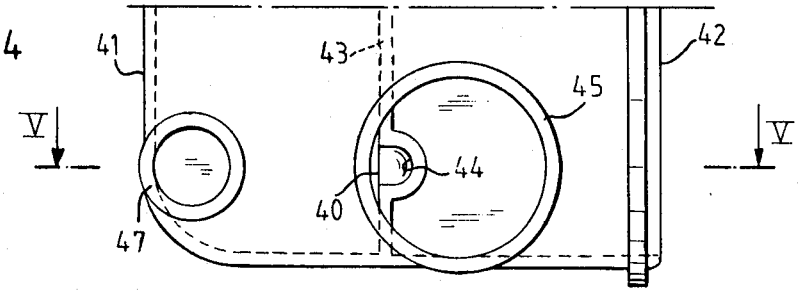
FIG. 4 is an outside view of the bottom part of a variant embodiment of the invention.
Figure 5:
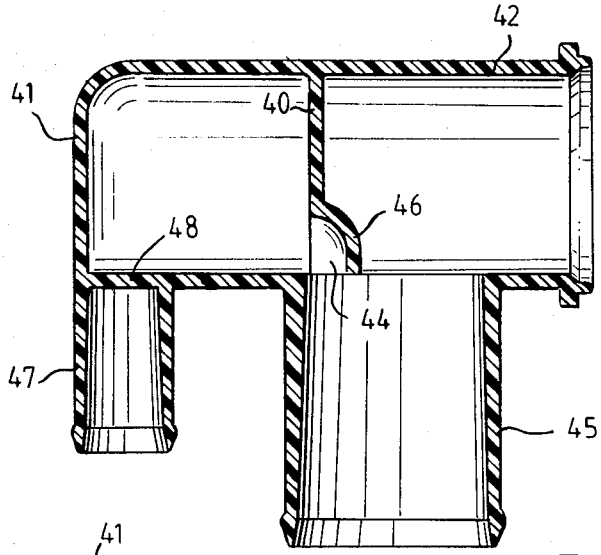
FIG. 5 is a section along a line V—V in FIG. 4 showing the first version of the device.
Figure 6:
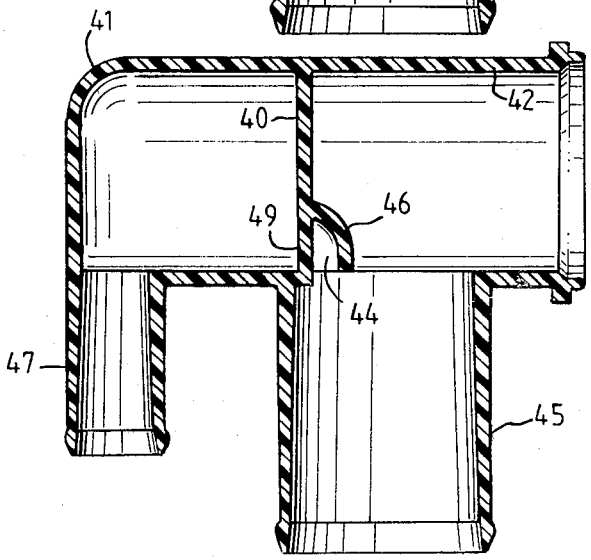
FIG. 6 is a similar view to FIG. 5, but showing the second version of the device.

Reference is now made to FIGS. 4 to 6 which show a variant embodiment of the invention, which differs from the embodiment shown in FIGS. 1 to 3 in that the stopper member 20 is replaced by a wall 40 which is moulded integrally with the expansion chamber 41 and the water box 42. The stopper wall 40 forms a part of the partition 43 separating the expansion chamber 41 from the water box 42, and has a channel 44 for communication between the bottom part of the expansion chamber 41 and the heat exchanger outlet tube 45 which is integrally moulded with the water box wall and projects perpendicularly therefrom as in the embodiment shown in FIGS. 1 to 3.

The channel 44 is delimited by a curved wall 46 having substantially the shape of one fourth of a sphere for example, similar to the curved wall 25 of the first embodiment.

A stub cylindrical tube 47 projects from the bottom of the expansion chamber 41 in a manner suitable for connection to the suction side of a pump for circulating cooling liquid.

In a first version shown in FIG. 5, the tube 47 is closed by a wall 48 which is integrally moulded with the tube 47 and with the wall of the expansion chamber 41, while in the FIG. 6 version the outlet tube 47 is open. In contrast the second, or FIG. 6 version, has the communication channel 44 closed by a wall 49 extending the wall 40, while the FIG. 5 version has this channel open.

Thus selection of one version or the other, is merely a matter of suitably selecting cores to put in the moulds during manufacture, with the moulds being good for either version.

I claim:

1. A water box and expansion chamber device for a heat exchanger such as a radiator in the cooling circuit of an internal combustion engine, wherein the expansion chamber and the water box are connected by an upper degassing passage, wherein the bottom of the water box is provided with an outlet tube for fluid outlet from the heat exchanger, and means forming a communication channel connecting the expansion chamber to said outlet tube through said water box, while maintaining separation between said expansion chamber and said water box.

2. A device according to claim 1, wherein said channel points in the direction of fluid flow along the outlet tube where it opens out therein.

3. A device according to claim 1, wherein the outlet tube extends substantially perpendicularly to the plane of the bundle of heat exchanger tubes, and wherein said channel has a right angle bend.

4. A device according to claim 1, wherein the water box and the expansion chamber are interconnected at their lower ends by a suction orifice or passage, and wherein said orifice or passage is masked or closed by a stopper in said communication channel.

5. A device according to claim 4, wherein the stopper comprises a circular disk having an annular flange projecting therefrom suitable for engaging said orifice or passage, and a curved wall to delimit said channel in the vicinity of a radial slot or cut-out in the disk and its flange.

6. A device according to claim 5, wherein the stopper has at least one projecting rod suitable for engaging the tube plate at the end of the heat exchanger core, whereby the stopper is retained pressed in the orifice or passage when the water box is assembled to the heat exchanger core.

7. A device according to claim 4, wherein the bottom portion of the expansion chamber has an outlet for connection to the suction side of a pump for circulating cooling fluid.

8. A device according to claim 7, wherein said stopper is turned through an angle such that the outlet from its channel is blocked by a wall of the water box, thereby rendering said channel inoperative, as is required for use with a Diesel engine.

9. A device according to claim 7, wherein said stopper is integrally moulded with a wall of the expansion chamber and the water box, one end of said communication channel being blocked by moulding, thereby rendering said channel inoperative, as is required for use with a Diesel engine.

* * * * *